US007389547B1

(12) United States Patent
Wiens

(10) Patent No.: US 7,389,547 B1
(45) Date of Patent: Jun. 24, 2008

(54) ATHLETIC GARMENT WITH ADJUSTABLE LEG SHIELDS

(76) Inventor: Joel J. Wiens, 2767 Highway 55, Eagan, MN (US) 55121

( * ) Notice: Subject to any disclaimer, the term of this patent is extended or adjusted under 35 U.S.C. 154(b) by 67 days.

(21) Appl. No.: 11/235,658

(22) Filed: Sep. 26, 2005

Related U.S. Application Data

(60) Provisional application No. 60/613,211, filed on Sep. 28, 2004.

(51) Int. Cl.
*A41D 13/00* (2006.01)

(52) U.S. Cl. ..... 2/227

(58) Field of Classification Search ..... 2/22, 2/23, 24, 62, 79, 227, 242, 267, 247–253, 2/455, 911; 128/881, 882; 602/23, 26, 61, 602/62, 63
See application file for complete search history.

(56) References Cited

U.S. PATENT DOCUMENTS

| | | | | |
|---|---|---|---|---|
| 759,833 | A | 5/1904 | Stall | |
| 2,561,872 | A * | 7/1951 | Krinick | 2/24 |
| 4,035,844 | A | 7/1977 | Atack et al. | |
| 4,561,123 | A * | 12/1985 | Hull | 2/23 |
| 5,134,726 | A * | 8/1992 | Ross | 2/465 |
| 5,377,693 | A | 1/1995 | Loper et al. | |
| 6,161,222 | A | 12/2000 | Strickland et al. | |
| 6,269,485 | B1 * | 8/2001 | Foreman | 2/22 |
| 7,219,372 | B2 * | 5/2007 | Frieler et al. | 2/23 |

* cited by examiner

*Primary Examiner*—Tejash Patel
(74) *Attorney, Agent, or Firm*—Richard John Bartz

(57) ABSTRACT

An athletic underpants having a body and legs with protective shields attached to the legs with releasable hook and loop fastener that allow the positions of the shields on the legs to be adjusted and the shields to be selectively removed from and attached to the legs.

10 Claims, 5 Drawing Sheets

ATHLETIC GARMENT WITH ADJUSTABLE LEG SHIELDS

CROSS REFERENCE TO RELATED APPLICATION

This application claims the benefit of the priority of U.S. Provisional Patent Application Ser. No. 60/613,211 filed Sep. 28, 2004.

FIELD OF THE INVENTION

The invention relates to athletic garments having adjustable and removable shields operable to protect a person's body. More particularly, the athletic garments are pants having legs with releasable fasteners for holding leg shields that protect a person's legs and thighs from external impact forces.

BACKGROUND OF THE INVENTION

Greek and Roman legionnaires used body armor as protective covering as a defense against weapons and projectiles. This armor included breast, hip and leg members to protect the body and legs of a warrior. Body armor is presently in use by the police and military. Protective sport garments are used in contact sports, such as baseball, softball, hockey, soccer, football and rugby. These garments include sport pants and trousers having pads for protection from impacting forces from balls, sticks and player contact. Examples of protective sport garments are discloses in the following U.S. Patents.

W. T. Stall in U.S. Pat. No. 759,833 discloses a padded garment comprising a trouser having a plurality of pads permanently secured to the outer surface of its body and legs. The inner surface of the trouser is smooth and adapted to fit the wearer without irritation due to the pads. The pads include left and right thigh pads permanently secured to the materials of the trouser legs with stitching.

J. W. Atack et al in U.S. Pat. No. 4,035,844 discloses a trouser undergarment made of elastic stretchable material designed to fit the contours of the body of a person. Auxiliary pockets at the knees and thighs accommodate padding. The thigh pockets are stitched only on three sides with the top open to permit the insertion of padding.

J. T. Ross in U.S. Pat. No. 5,134,726 discloses a sport pants having a trunk and legs of elastic stretchable material with hip and knee pockets for accommodating pads of resilient closed cell foam material which are removable and replaceable in the pockets for protection of the wearer. The sport pants is washable underwear with padding to mitigate scrapes and bruises in athletic competition and games.

D. C. Strickland and M. T. Cheatwood in U.S. Pat. No. 6,161,222 discloses an athletic garment with guard members to protect the athletic inner thighs. The legs of the garment have pockets on the inside of the thigh portions of the garment's legs for holding pads. The pads are flexible so that they will conform to the shape of the thigh and bend when the athlete moves. In use, the pads absorb impact and shock forces of a ball or other blow to the inner thigh during sport activities. The pads are not removable from the pockets. The positions of the pads relative to the legs of the garment are not adjustable, as the pads are in fixed positions within the pockets.

The objects and advantages of the invention are embodied in the following description in connection with the accompanying drawings of a preferred embodiment of the athletic garment with adjustable and removable leg shields.

SUMMARY OF THE INVENTION

The invention relates to a garment for protecting an athlete's legs from impact forces incurred during sport activities and athletic games. The impact forces subjected to the athlete's legs can result from physical contact of players, balls, pucks, hockey sticks, and sliding contact with ground. Shields releasably fastened to the garment protect an athlete's body and legs from concentrated impact forces and mitigate scrapes, bruises and injury to muscle groups and bones. Releasable fasteners having connectable members attach the shields to the garment in adjustable selected positions according to the need and preference of the athletes.

An embodiment of the combined garment and shields comprises underwear pants having a body and a pair of legs. Shields having flexible and compressible pads are attached to the legs with releasable fasteners that allow the pads to be attached to the legs in selected positions and permit the pads to be removed from the legs without removing the pants from the athlete. The releasable fasteners are hook and loop strips known as VELCRO fasteners. Horizontal loop strips are secured to the legs of the pants. Vertical hook strips are secured to the pads. The loop strips interengage with the hook strips to retain the pads in adjusted selected positions on the legs as determined by the athlete. The loop and hook strips can be separated whereby the pads are removable from the legs of the pants. The pads have flat, generally rectangular shapes with compressible open cell plastic cores. The sides of the cores are joined to air impervious covers. The pads have rows of spaced holes that allow air to flow out of and into the cores responsive to application of impact forces to the pads and dissipation of energy throughout the pads.

DESCRIPTION OF THE INVENTION

Figure 3:
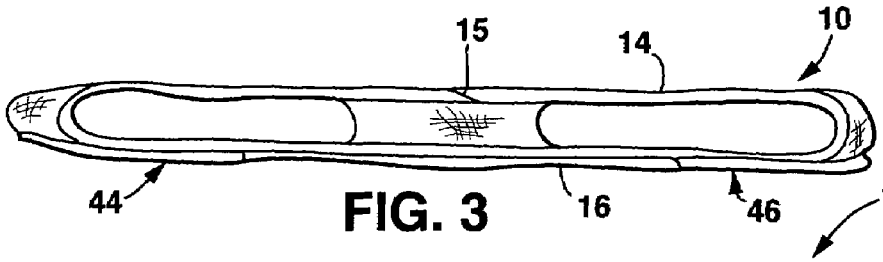
FIG. 3 is a top plan view of FIG. 1.
Figure 1:
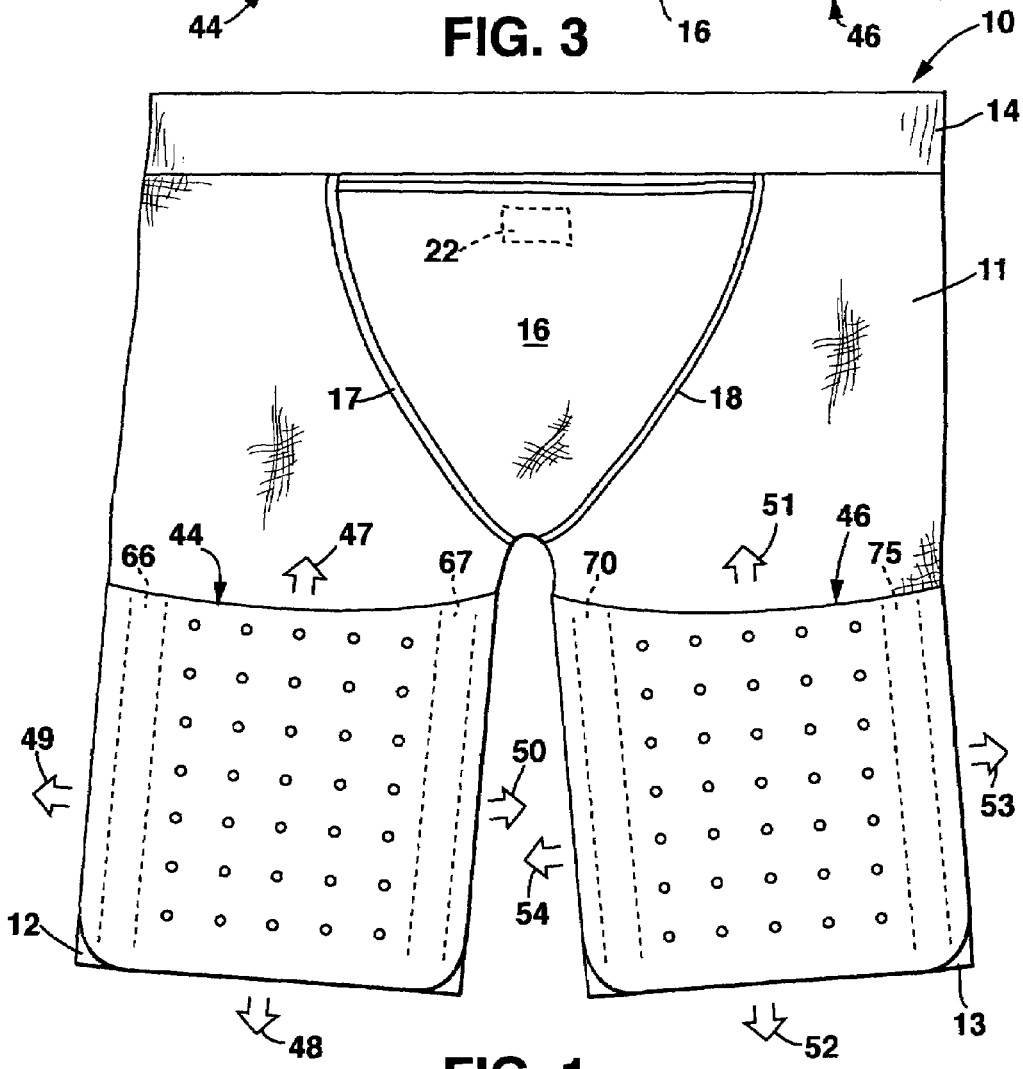
FIG. 1 is a front elevational view of the athletic garment with removable leg shields of the invention.
Figure 2:
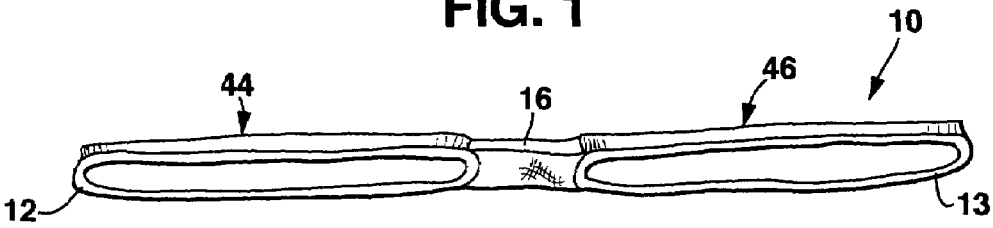
FIG. 2 is a bottom plan view of FIG. 1.

The athletic garment 10 of the invention shown in FIG. 1 is a protective padded pant having a lower body 11 joined to right and left legs 12 and 13. Body 11 has a flexible waist band 14 secured in a loop with stitches 15 adapted to surround a person's abdomen. Garment 10 is made from elastic, washable and durable fabric. An example of a fabric is a polyester and polyolefin material shaving moisture wicking and four-way stretch compression characteristics. Other types of materials can be used to make garment 10. Legs 12 and 13 surround an athlete's thighs or legs above the knees. Shields 44 and 46 are attached releasable connectors to legs 12 and 13 in locations that deflect and absorb impact forces from projectiles, such as baseballs, footballs, soccer balls and hockey pucks in sport activities. The locations of shields 44 and 46 on legs 12 and 13 are selected to protect an athlete's thighs, including but not limited to adductor, gracilis, rectus femoris and sartorius human muscle groups. Shield 44 is adjustable up and down relative to leg 12 shown by arrows 47 and 48 and sidewise or left to right on leg 12 shown by arrows 49 and 50. Shield 44 is adjusted on leg 12 to a position to protect the front and inside of the athlete's right thigh. Shield 46 is adjustable up and down shown by arrows 51 and 52 and sidewise or left to right shown by arrows 53 and 54 on leg 13 to protect the front and inside of the athlete's left thigh. The positions of shields 44 and 46 are adjustable to accommodate different needs of the athletes. Shields 44 and 46 can be removed from and placed on legs 12 and 13 without removing garment 10 from the athlete's body. Garment 10 is shown as short pants or shorts. The garment can take the form of long pants or any item of apparel that covers the athlete's thighs. Shields 44 and 46 can be releasably connected to lower leg portions of long pants. Garment 10 with adjustable leg shields 44 and 46 are described with reference to sport activities of human male and female athletes. Garment 10 can be used to improve human thigh and leg alignment as disclosed by E. C. Loper and C. B. Berger in U.S. Pat. No. 5,377,693.

Figure 6:
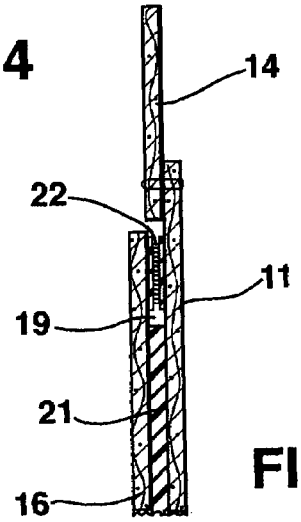
FIG. 6 is an enlarged sectional view taken along the line 6-6 of FIG. 4.

A V-shaped fabric member 16 attached to the front of body 11 with seams 17 and 18 provides a pocket 19 for accommodating a protective device, such as a V-shaped pad or cup 21 for covering reproductive body parts. Cup 21 can be a flexible high impact plastic member. A releasable fastener 22, shown in FIG. 6, as a hook and loop fastener or VELCRO fastener, attaches the top of member 16 to body 11 to retain cup 21 in pocket 19.

Figure 7:
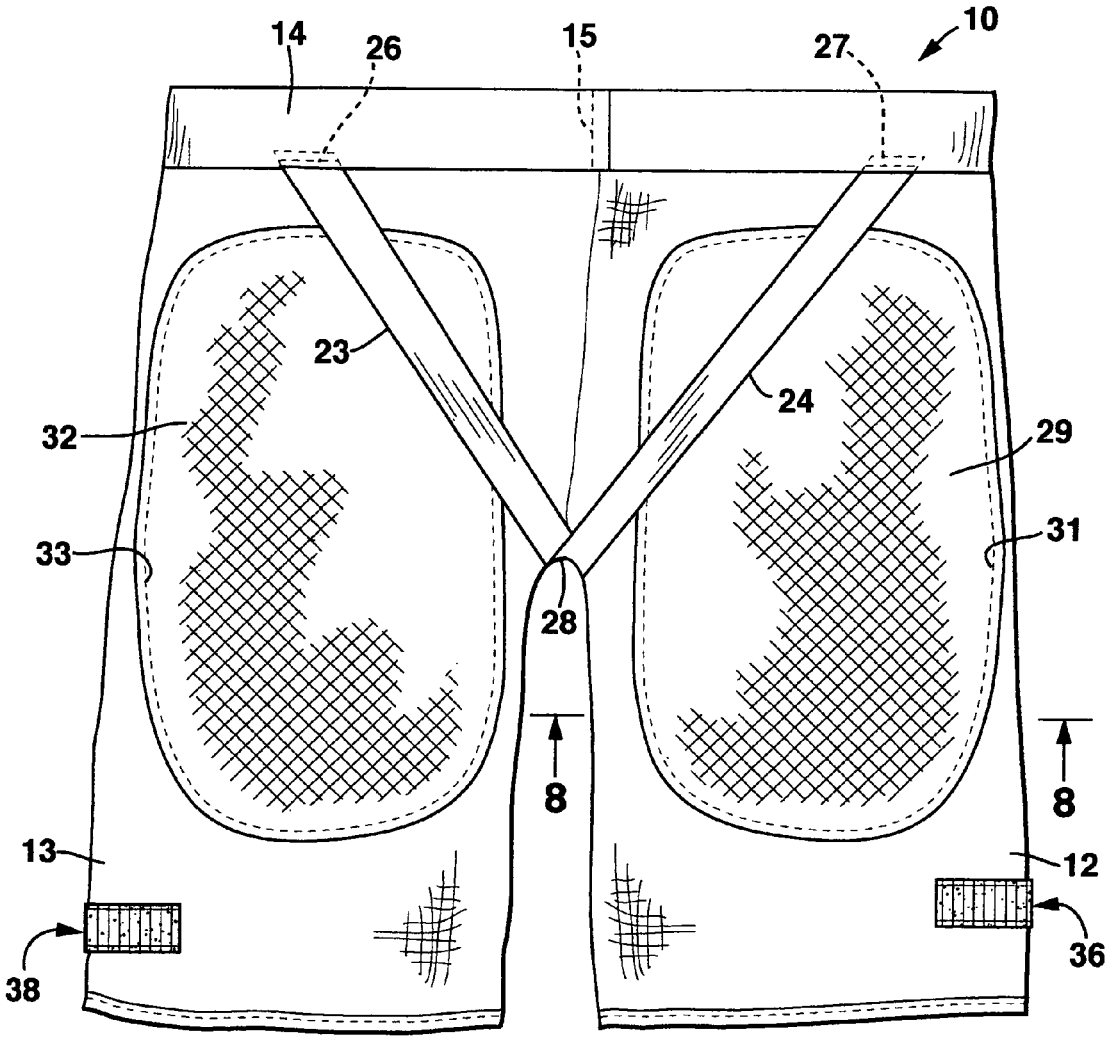
FIG. 7 is a rear elevational view of FIG. 1.
Figure 8:
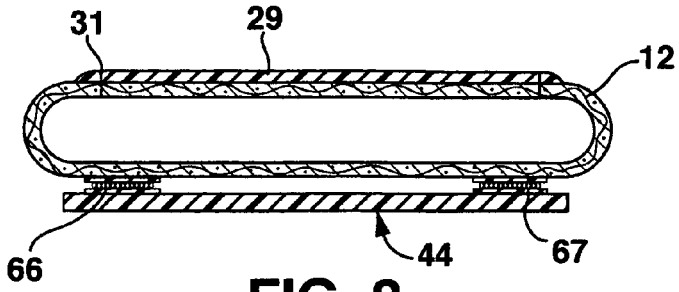
FIG. 8 is an enlarged sectional view taken along the line 8-8 of FIG. 7.

As shown in FIG. 7, a pair of elastic straps 23 and 24 attached with stitches 26 and 27 to body 11 and waist band 14 extend downward and inward to inseam 28. The lower ends of straps 23 and 24 overlap and are secured to body 11. Flexible pads or cushions 29 and 32 are secured with stitches 31 and 33 to the back sections of body 11 and legs 12 and 13. Cushions 29 and 32 are upright rectangular generally flat foam plastic members with fabric covers. Other types and shapes of cushions can be attached to body 11 and legs 12 and 13. Cushions 29 and 32 absorb impact and sliding forces on the athlete's body and legs during sliding movements of the athlete, such as a slide to a base in baseball.

Figure 4:
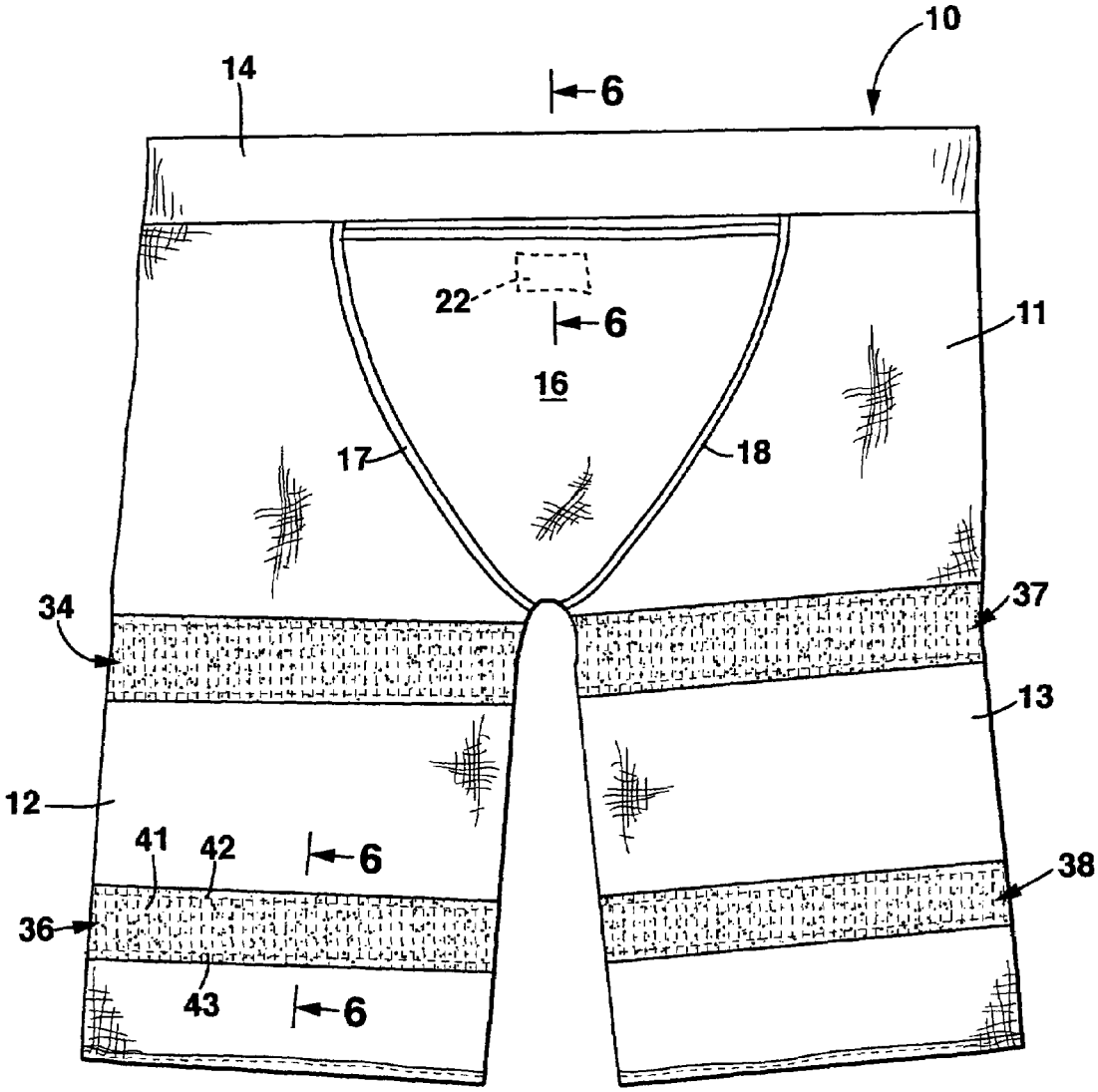
FIG. 4 is a front elevational view of the athletic garment without removable leg shields.
Figure 5:
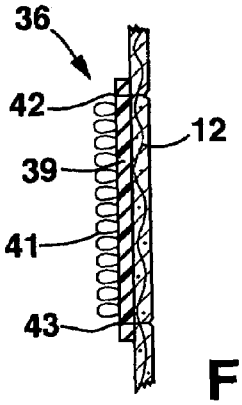
FIG. 5 is an enlarged sectional view taken along the line 5-5 of FIG. 4.

As shown in FIG. 4, the releasable fastener includes a pair of direct horizontal loop strips 34 and 36 attached with stitches 42 and 43 to leg 12. Loop strips 34 and 36 are generally parallel and vertically spaced from each other. A pair of second horizontal loop strips 37 and 38 attached to leg 13 are located in general horizontal alignment with loop strips 34 and 36. As shown in FIG. 5, strip 36 has a flat base tape 39 supporting lateral rows of plastic loops 41. Stitches 42 and 43 secure tape 39 to leg 12. Strips 34, 37 and 38 have base tapes and rows of plastic loops as illustrated in FIG. 5. The loop strips 34, 36, 37 and 38 are loop components of releasable VELCRO fasteners.

Leg shield 44, shown in FIGS. 9 to 14, comprises a flat, generally rectangular flexible pad 56 having a foam plastic core 57 joined to inner and outer skins or external layers of plastic material 58 and 59. Core 57 is an open cell foam plastic, such as open cell urethane. Skins 58 and 59 are close cell plastic layers that protect core 57 and limit flow of air and liquids into and out of core 57. Pad 56 has vertical and horizontal rows of spaced holes 61 that allow air to flow into and out of the open cell material of core 57 when subjected to an impact force, such as a moving ball or puck. The compression of core 57 and the energy to force air out of core 57 through holes 61 dissipates the impact forces subjected to the athlete's thigh. Core 57 expands to its normal size after the impact forces have been dissipated. Pad 56 has a broad concave top edge 62, a horizontal bottom edge 63 and upright opposite side edges 64 and 65. The vertical rows of holes 61 are generally parallel to side edges 64 and 65.

Figure 12:
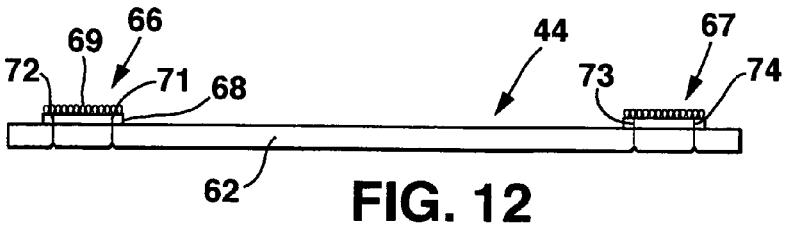
FIG. 12 is a top plan view of FIG. 9.
Figure 9:
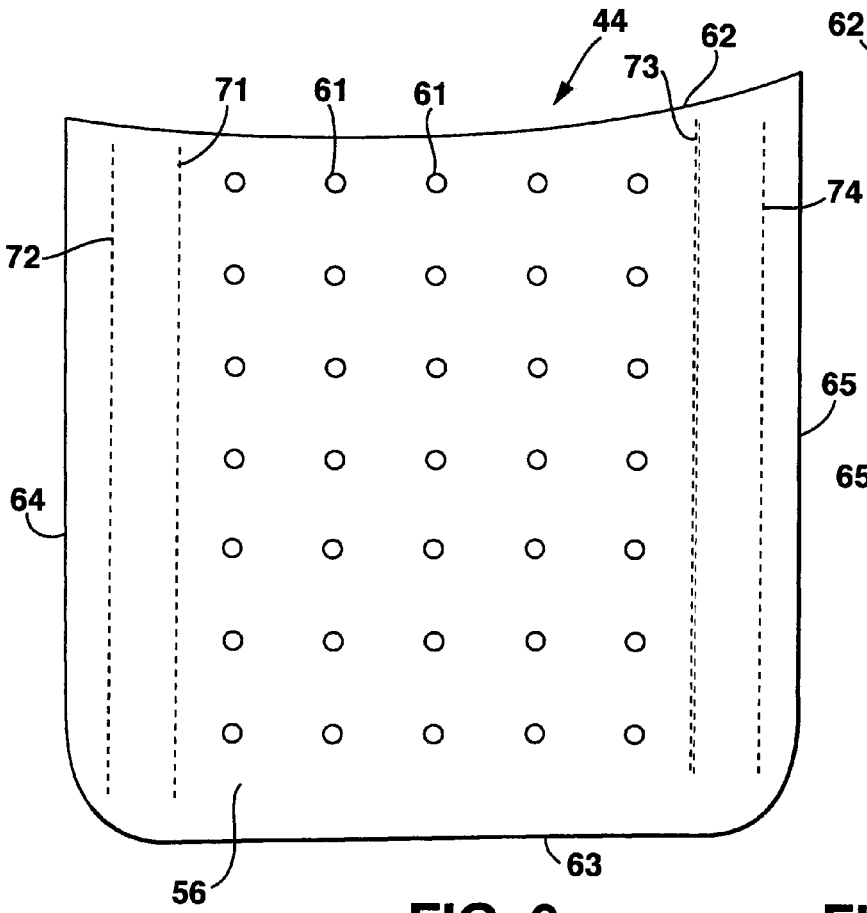
FIG. 9 is a front elevational view of a leg shield for the athletic garment of FIG. 1.
Figure 10:
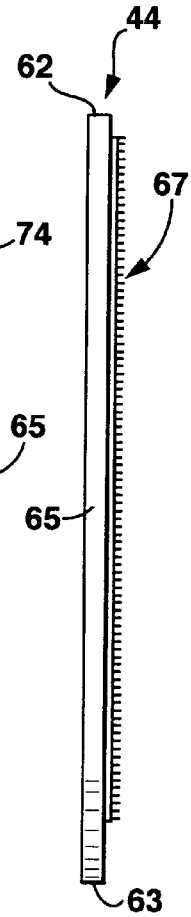
FIG. 10 is a side elevational view of FIG. 9.
Figure 11:
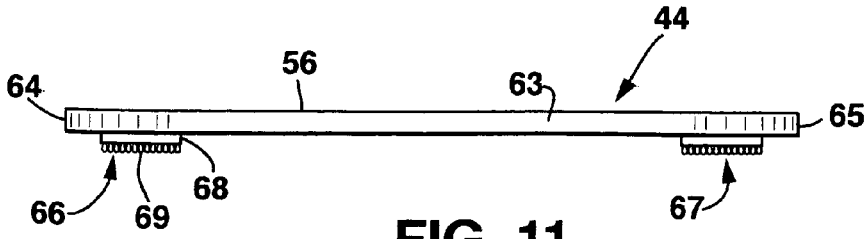
FIG. 11 is a bottom plan view of FIG. 9.
Figure 13:
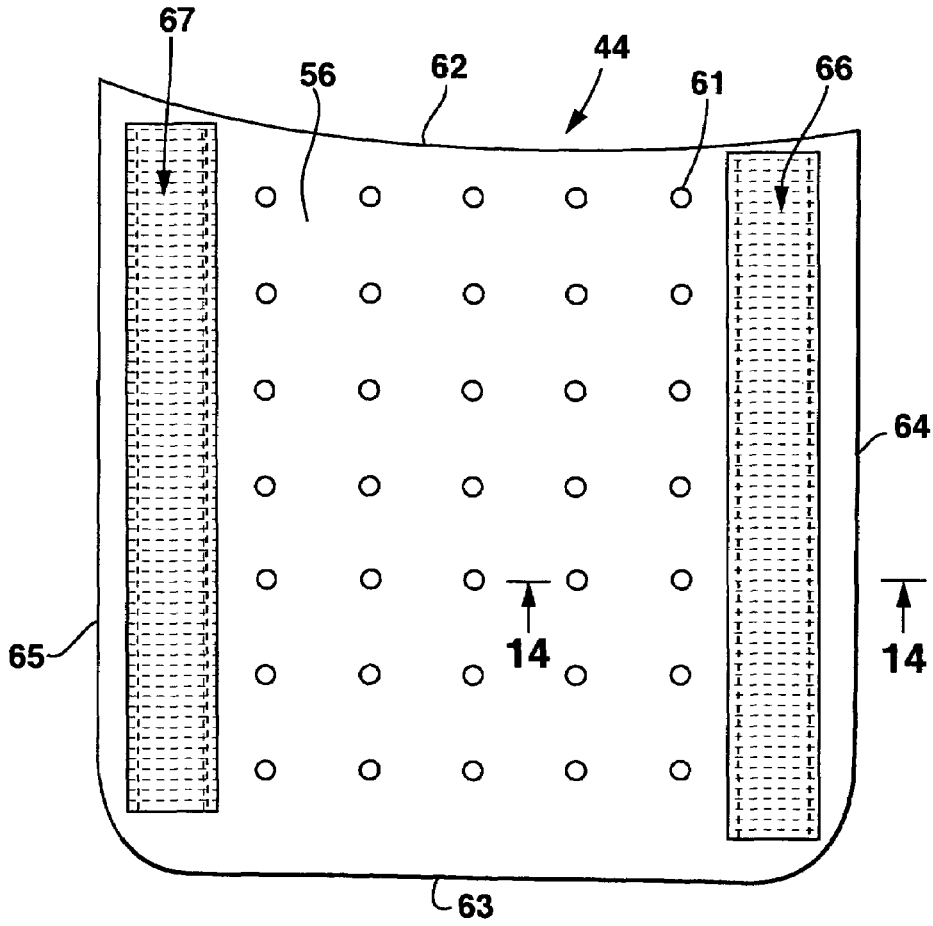
FIG. 13 is a rear elevational view of FIG. 9.
Figure 14:
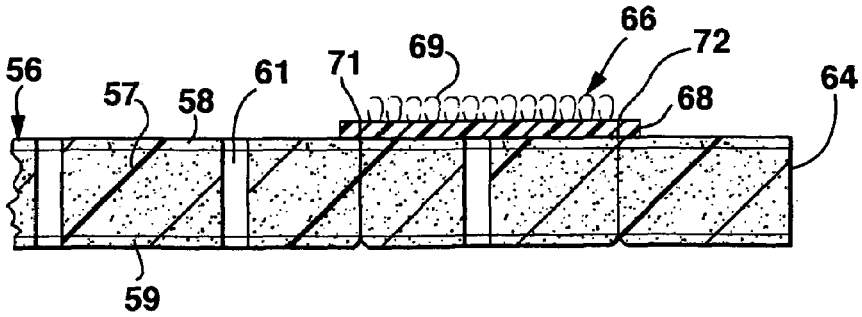
FIG. 14 is an enlarged sectional view taken along line 14-14 of FIG. 13.

As shown in FIG. 13, vertical hook strips 66 and 67 are secured to the back of pad 44. Hook strips 66 and 67 are components of a releasable fastener, known as a VELCRO fastener, that cooperate with loop strips 34 and 36 to hold pad 44 on leg 12. Strip 66 located adjacent side edge 64 extends from top edge 62 to adjacent bottom edge 63. As shown in FIG. 14, strip 66 has a flat base tape 68 supporting outwardly extended plastic hook elements 69. Stitches 71 and 72 attach opposite sides of tape 68 to pad 56. Other types of fasteners, such as heat seams, adhesives and connectable members, can be used to attach strip 66 to pad 56. Strip 67 is parallel to strip 66 and has the same components as strip 66. Strip 67 located adjacent side edge 65 extends from top edge 62 to adjacent bottom edge 63. As shown in FIGS. 9 and 12, stitches 73 and 74 secure strip 67 to pad 56. Shield 46 has the same components as shield 44 including vertical hook strips on the back of the pad adjacent its opposite side edges.

In use, vertical hook strips 66 and 67 on pad 56 cooperate with horizontal loop strips 34 and 36 to attach pad 44 to leg 12. Vertical strips 66 and 67 allow pad 56 to be adjusted up or down relative to leg 12 as shown by arrows 47 and 48 in FIG. 1. The horizontal loop strips 34 and 36 allow pad 56 to be adjusted sidewise or left or right relative to leg 12. The hook strips 66 and 67 and loop strips 34 and 36 also permit shield 44 to be removed from leg 12 with the garment 10 retained on the athlete. Shield 44 can be attached to leg 12 when garment 10 is either on or removed from the athlete. Shield 46 is vertically and horizontally positioned on leg 13 with the horizontal loop strips 37 and 38 cooperating with vertical hook strips. Shield 46 is adjusted up and down on leg 13, as shown by arrows 51 and 52 in FIG. 1, and sidewise or right and left, as shown by arrows 53 and 54 in a position most needed by the athlete. The hook and loop fasteners also allow shield 46 to be removed from leg 13 and placed back on leg 13 at any time during use. Releasable fasteners shown as loop strips 34, 36, 37 and 38 on legs 12 and 13 and hook strips 66, 67, 70 and 75 on shields 44 and 46 can be interchanged with the loop strips on shields 44 and 46 and hook strips on legs 12 and 13.

There has been shown and described a garment having adjustable leg shields attached to the legs of the garment with releasable hook and leg fasteners. Modifications of the structures, materials and arrangement of the elements may be made by persons skilled in the art without departing from the scope of the invention.

The invention claimed is:

1. A garment for protecting a person's legs from impact forces consisting of: a pants having a lower body portion and right and left legs joined to the body portion for accommodating the lower body and legs of a person, first thigh shield, first releasable fasteners connecting the first thigh shield on the right leg of the pants, a second thigh shield, and second releasable fasteners connecting the second thigh shield to the left leg of the pants, said first and second thigh shields each comprising a pad having an open cell plastic core having opposite sides, skins of air impervious material joined to the opposite sides of the core, and a plurality of holes through said skins and core to allow air to flow through the skins and out of and into the core, the first releasable fasteners comprising a first pair of spaced horizontal strips having first connectable members secured to the right leg of the pants, and a pair of spaced vertical strips having second connectable members secured to the first thigh shield, said first and second connectable members releasably interengaging each other to connect the first thigh shield in a selected vertical and lateral position on the right leg of the pants, the second releasable fastener comprising a pair of spaced horizontal strips having first connectable members secured to the left leg of the pants and a second pair of spaced vertical strips having second connectable members secured to the second thigh shield, said first and second members of the second releasable fastener releasably interengaging each other to connect the second thigh shield in a selected vertical and lateral position on the left leg of the pants.

2. The garment of claim 1 wherein: the first releasable fasteners are cooperating hook and loop members for connecting the first shield in an adjusted position on the right leg of the pants, and the second releasable fasteners are cooperating hook and loop members for connecting the second shield in an adjusted position on the left leg of the pants.

3. The garment of claim 1 wherein: the first thigh shield has opposite vertical side edges, said spaced first pair of vertical strips including a first vertical strip located adjacent one side edge of the first thigh shield and a second vertical strip located adjacent the other side edge of the first thigh shield, said second thigh shield having opposite side vertical side edges, said spaced vertical strips of the second pair of spaced vertical strips including a first vertical strip located adjacent one side edge of the second thigh shield and a second vertical strip located adjacent the other side edge of the second thigh shield.

4. The garment of claim 3 wherein: the connectable members comprise hook and loop members.

5. The garment of claim 1 wherein: the pad is a flat, generally square and flexible member.

6. The garment of claim 1 wherein: the holes are arranged in vertical and horizontal rows of spaced holes.

7. The garment of claim 1 including: means providing a pocket in the lower body portion of the pants for accommodating a cup to protect a part of the body.

8. A garment for protecting a person's legs from impact forces consisting of: a pants having a lower body portion and right and left legs joined to the body portion for accommodating the lower body and legs of a person, a first thigh shield, first releasable fasteners connecting the first thigh shield on the right leg of the pants, a second thigh shield, and second releasable fasteners connecting the second thigh shield to the left leg of the pants, said first and second thigh shields each comprising a flat and flexible pad having a compressible open cell plastic core having opposite sides, a first outer skin of air impervious material joined to one side of the core, a second skin of air impervious material joined to the other side of the core, a plurality of vertical and horizontal rows of spaced apart holes extended through said first and second skins and pad to allow air to flow through said first and second skins and out of and into the core when subjected to an impact force the first releasable fasteners comprising a first pair of spaced horizontal strips having first connectable loop members secured to the right leg of the pants, and a pair of laterally spaced vertical strips having second connectable hook members secured to the first thigh shield, said first and second connectable loop and hook members releasably interengaging each other to connect the first thigh shield in a selected vertical and lateral position on the right leg of the pants, the second releasable fastener comprising a pair of spaced horizontal strips having first connectable loop members secured to the left leg of the pants and a second pair of spaced vertical strips having second connectable hook members secured to the second thigh shield, said first and second loop and hook members of the second releasable fastener releasably interengaging each other to connect the second thigh shield in a selected vertical and lateral position on the left leg of the pants.

9. The shield of claim 8 wherein: the pad is a flat generally square and flexible member.

10. The shield of claim 8 wherein: the pad has opposite side edges, said releasable fasteners comprising a first elongated strip having hook members secured to the pad adjacent one side edge and a second elongated strip having hook members secured to the pad adjacent the other side edge.

* * * * *